US006064348A

United States Patent [19]

Cosenza et al.

[11] Patent Number: 6,064,348

[45] Date of Patent: May 16, 2000

[54] METHOD AND APPARATUS FOR A DUAL FREQUENCY BAND ANTENNA

[75] Inventors: John Cosenza, St. James; Michael Kane, Ridge; Vincent Marotti, Sayville, all of N.Y.

[73] Assignee: AIL Systems, Inc., Deer Park, N.Y.

[21] Appl. No.: 09/298,049

[22] Filed: Apr. 21, 1999

Related U.S. Application Data

[63] Continuation of application No. 08/837,358, Apr. 17, 1997.

[51] Int. Cl.[7] ..... H01Q 13/10

[52] U.S. Cl. ..... 343/770; 343/753; 343/853

[58] Field of Search ..... 343/770, 853, 343/753, 778, 700 MS; H01Q 13/10

[56] References Cited

U.S. PATENT DOCUMENTS

| | | | |
|---|---|---|---|
| Re. 28,546 | 9/1975 | Foldes . | |
| 4,083,050 | 4/1978 | Hall . | |
| 4,259,672 | 3/1981 | Newcomb . | |
| 4,675,685 | 6/1987 | Finken | 343/853 |
| 4,689,627 | 8/1987 | Lee et al. . | |
| 4,723,305 | 2/1988 | Phillips et al. . | |
| 4,728,960 | 3/1988 | Lo | 343/700 MS |
| 4,740,795 | 4/1988 | Seavey . | |
| 4,771,291 | 9/1988 | Lo et al. . | |
| 5,223,848 | 6/1993 | Rammos et al. | 343/700 MS |
| 5,428,364 | 6/1995 | Lee et al. . | |
| 5,495,258 | 2/1996 | Muhlhauser et al. | 343/853 |
| 5,532,706 | 7/1996 | Reinhardt et al. | 343/853 |
| 5,724,050 | 3/1998 | Tokuda et al. . | |

FOREIGN PATENT DOCUMENTS

| | | |
|---|---|---|
| 0215535 | 1/1986 | European Pat. Off. . |
| 0464255A1 | 9/1990 | European Pat. Off. . |

*Primary Examiner*—Don Wong
*Assistant Examiner*—Hoang Nguyen
*Attorney, Agent, or Firm*—Hoffmann & Baron, LLP

[57] ABSTRACT

An apparatus and method for exciting an antenna with dual frequency bands which comprises feeding a first channel of the antenna with a first signal in the VHF band such that a first current is established in a first direction resulting in a first polarization, feeding a second channel of the antenna with a second signal such that a second current is established in a second direction resulting in a second polarization, and isolating characteristics of the first channel from characteristics of the second channel and the characteristics of the second channel from the characteristics of the first channel such that both the first channel and the second channel are adapted to transmit and receive energy within the same antenna structure without appreciable coupling between the first channel and the second channel.

12 Claims, 7 Drawing Sheets

METHOD AND APPARATUS FOR A DUAL FREQUENCY BAND ANTENNA

This application is a continuation of U.S. patent application Ser. No. 08/837,358, filed on Apr. 17, 1997.

TECHNICAL FIELD

The present invention relates to antennas, and more particularly, to antennas capable of simultaneously transmitting and receiving dual frequency bands within one physical structure.

BACKGROUND OF THE INVENTION

For modern high-speed aircraft, there is a need for multiband antennas which are mounted to the exterior of an aircraft and which present a reduced potential for aerodynamic loading. In the past such an antenna has been supplied in the form of printed circuit elements carried on dielectric substrates fastened to mounting flanges and molded into a housing comprised of a smooth blade. An antenna of this type designed for the C and D bands (750 to 1200 Mhz) with good I-band coverage as well was disclosed in U.S. Pat. No. 4,083,050 and is hereby incorporated by reference Requirements have recently arisen for a similar antenna which is capable of receiving signals in the VHF band and the cellular communications L-band. Since the L-band is substantially displaced in frequency from the VHF band, this requirement would normally dictate separate antennas structures. However, even relatively small appendages on modern high-speed aircraft cannot always be attached without adverse effects upon the aerodynamic operation and performance of the aircraft.

Therefore, it would be desirable to simultaneously accommodate both L-band and VHF band requirements in one physical antenna structure without significant changes to the mechanical structure of an existing antenna nor coupling between the bands which may lead to interference and thus degradation in performance within both bands.

SUMMARY OF THE INVENTION

In accord with the present invention a method of exciting an antenna is provided comprising the steps of feeding a first channel of the antenna with a first signal such that a first current is established in a first direction resulting in a first polarization, feeding a second channel of the antenna with a second signal such that a second current is established in a second direction resulting in a second polarization, and isolating electrical and electromagnetic characteristics of the first channel from the second channel and vice versa such that both the first channel and the second channel are adapted to transmit and receive energy simultaneously within the same antenna structure without appreciable coupling between the first channel and the second channel in order to avoid significant degradation in performance of the first channel and the second channel.

In further accord with the method of the present invention the first signal may occupy the VHF band and the second signal may occupy the cellular communications L-band. The method of the present invention is particularly adaptable to airborne applications.

In still further accord with the method of the present invention the step of feeding the first channel may result in polarization in a vertical direction and the step of feeding the second channel may result in polarization in a horizontal direction or simply ensuring that the resulting polarizations are orthogonal with respect to each other.

In further accord with the method of the present invention the antenna may further comprise the step of providing a first and a second cavity backed vertical slot in a face-to-face arrangement. The first cavity backed vertical slot is fed by the first channel and the second cavity backed vertical slot is excited by the first cavity backed vertical slot. Dielectric loading of the vertical slots may be performed with an air gap or a dielectric material other than air and the first cavity backed vertical slot may be fed at substantially its longitudinal center. The method of the present invention may further comprise the step of tuning the first channel with a VHF matching circuit comprising reactance which will increase efficiency within the VHF band while ensuring electrical and electromagnetic isolation between the first and second channels.

In accord with an apparatus of the present invention the antenna comprises a first feed which carries a first signal within a first channel such that a first current is established in a first direction resulting in a first polarization, and a second feed which carries a second signal within a second channel such that a second current is established in a second direction resulting in a second polarization The first feed and the second feed are adapted such that electrical and electromagnetic characteristics of the first channel are isolated from electrical and electromagnetic characteristics of the second channel and vice versa. The isolation results in the first channel and the second channel being adapted to transmit and receive energy simultaneously within one of the antennas without appreciable coupling between the first channel and the second channel, thereby avoiding significant degradation in performance of either channels.

In further accord with the apparatus of the present invention the antenna may comprise a first signal in the VHF band and a second signal in the cellular communications L-band second. The antenna is particularly adaptable to airborne applications.

In further accord with the apparatus of the present invention the first polarization may be in a vertical direction and the second polarization may be in a horizontal direction. Alternatively the first polarization and second polarization may merely be constrained to be orthogonal with respect to each other.

In further accord with the apparatus of the present invention the antenna may further comprise a first and a second cavity backed vertical slot in a face-to-face arrangement, the first cavity backed vertical slot being fed by the first channel and the second cavity backed vertical slot being excited by the first cavity backed vertical slot. The vertical slot of the antenna may be dielectrically loaded with an air gap or a dielectric material other than air. The first cavity backed vertical slot may be fed at substantially the longitudinal center of the first cavity backed vertical slot.

In further accord with the apparatus of the present invention the first channel may further comprise a VHF matching circuit comprising reactance, which is adapted to tune the first channel and increase efficiency within the first channel while electrically and electromagnetically isolating the first channel from the second channel.

DETAILED DESCRIPTION OF THE INVENTION

One goal of the present invention is to provide a dual VHF band/cellular communications L-band antenna using a modified small scale CT4 type antenna blade which is commercially available from the assignee of the present invention, Dorne & Margolin, Inc., 2950 Veterans Memorial Highway, Bohemia, N.Y. 11716 while improving performance in the cellular communications L-band over the CT4 type antenna. The CT4 type antenna blade comprises a slant back antenna blade of approximately 7 inches in height having both vertical and horizontally polarizing apertures. Another goal of the present invention is to design an antenna that was smaller than the medium scale CT3 type antenna blade which is also commercially available from the assignee of the present invention, Dorne & Margolin, Inc., 2950 Veterans Memorial Highway, Bohemia, N.Y. 11716 and is a slant back antenna blade of approximately 12 inches in height comprised of a horizontally polarized cellular communications antenna that is positioned atop a vertically polarized cellular communications antenna.

The VHF band typically occupies a frequency range of 30 Mhz to 300 Mhz. The L-band theoretically occupies a frequency range of 390 Mhz to 1.556 Ghz, however, the typical frequency range for cellular communications is 824 Mhz to 896 Mhz.

Figure 1:
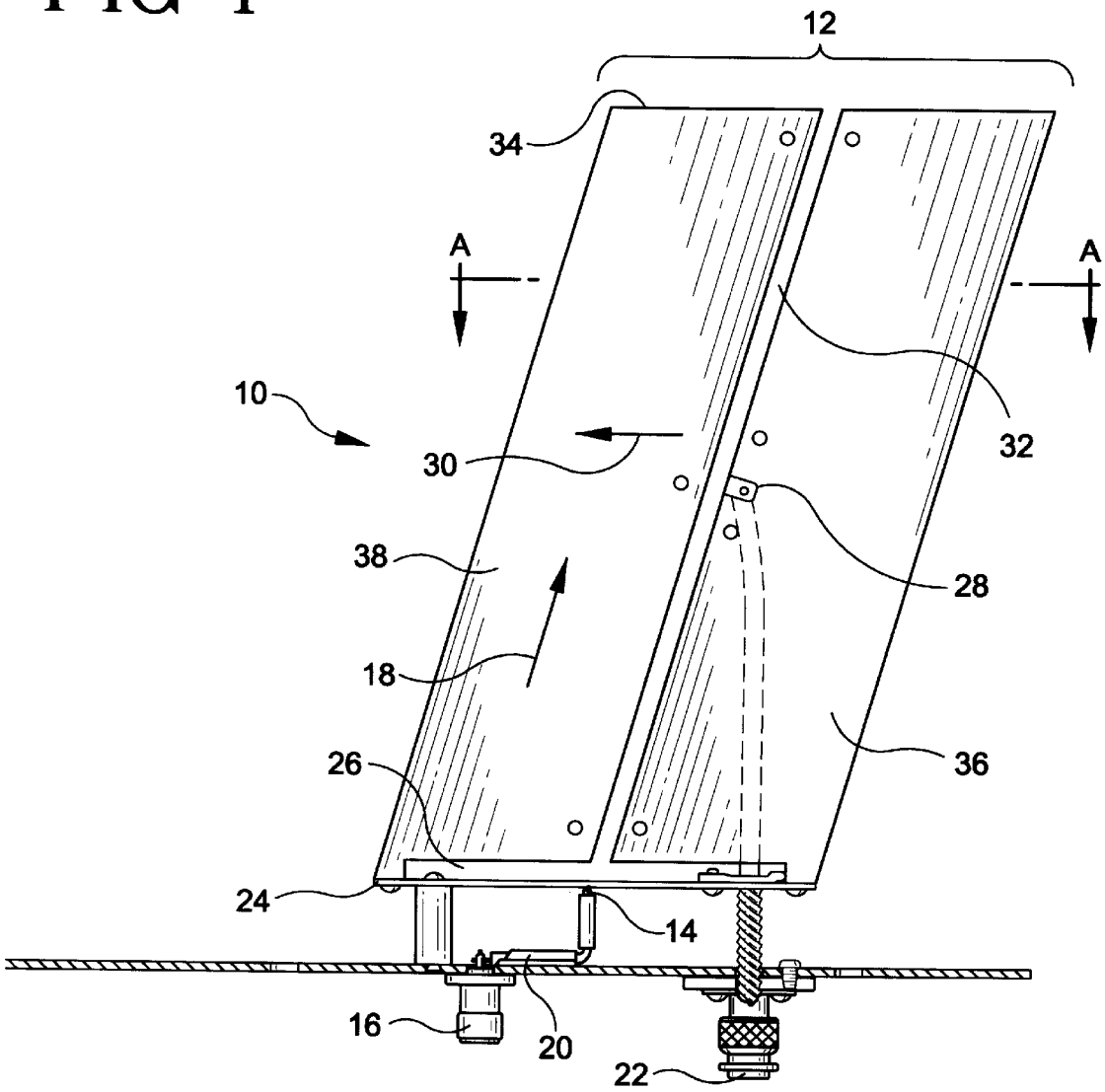
FIG. 1 represents a side view of an embodiment of the apparatus for a dual frequency band antenna of the present invention.
Figure 6:
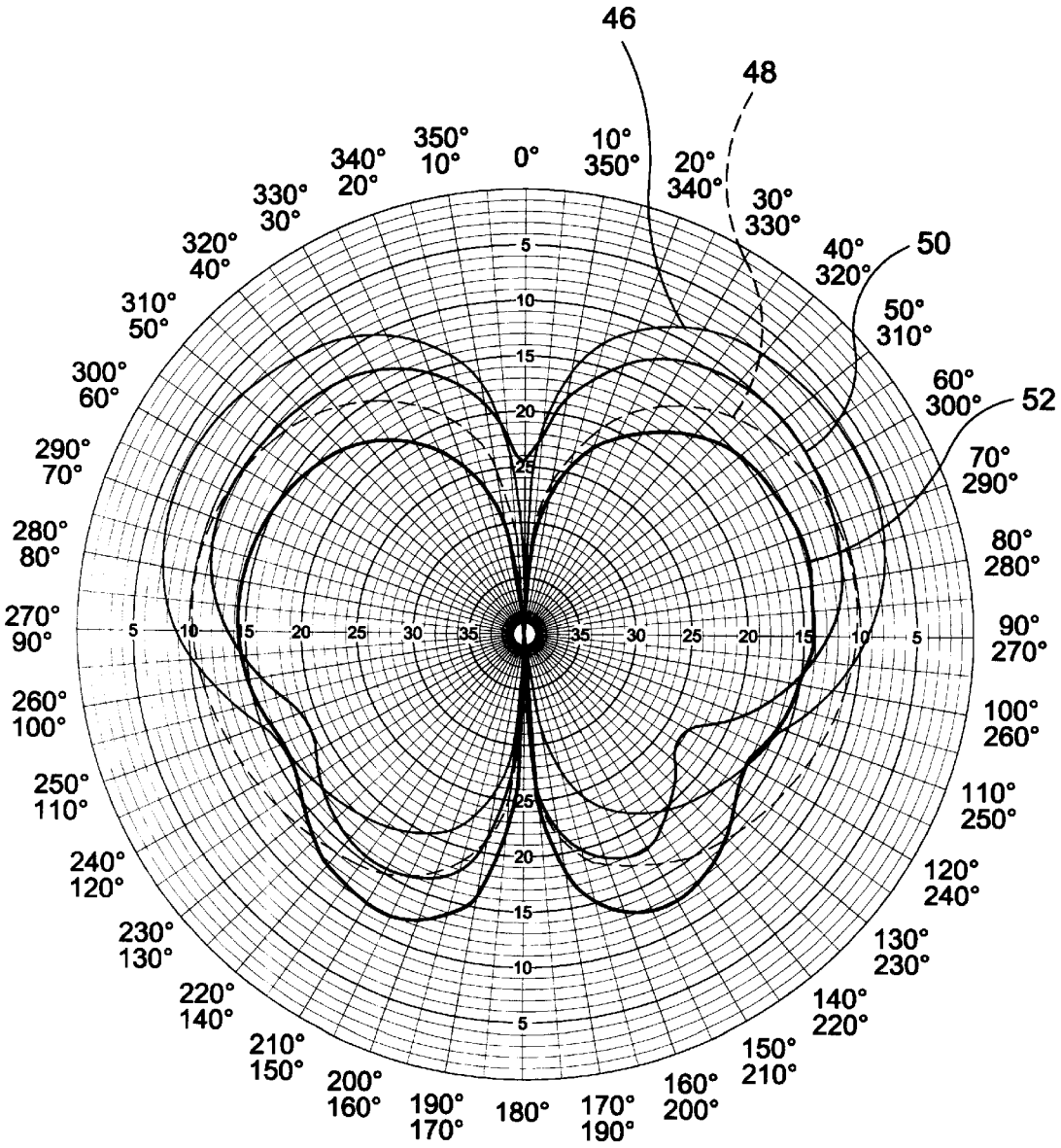
FIG. 6 illustrates a Fore/Aft and Port/Starboard radiation pattern for both a standard monopole or whip antenna and the antenna of the present invention at 118 Mhz.
Figure 7:
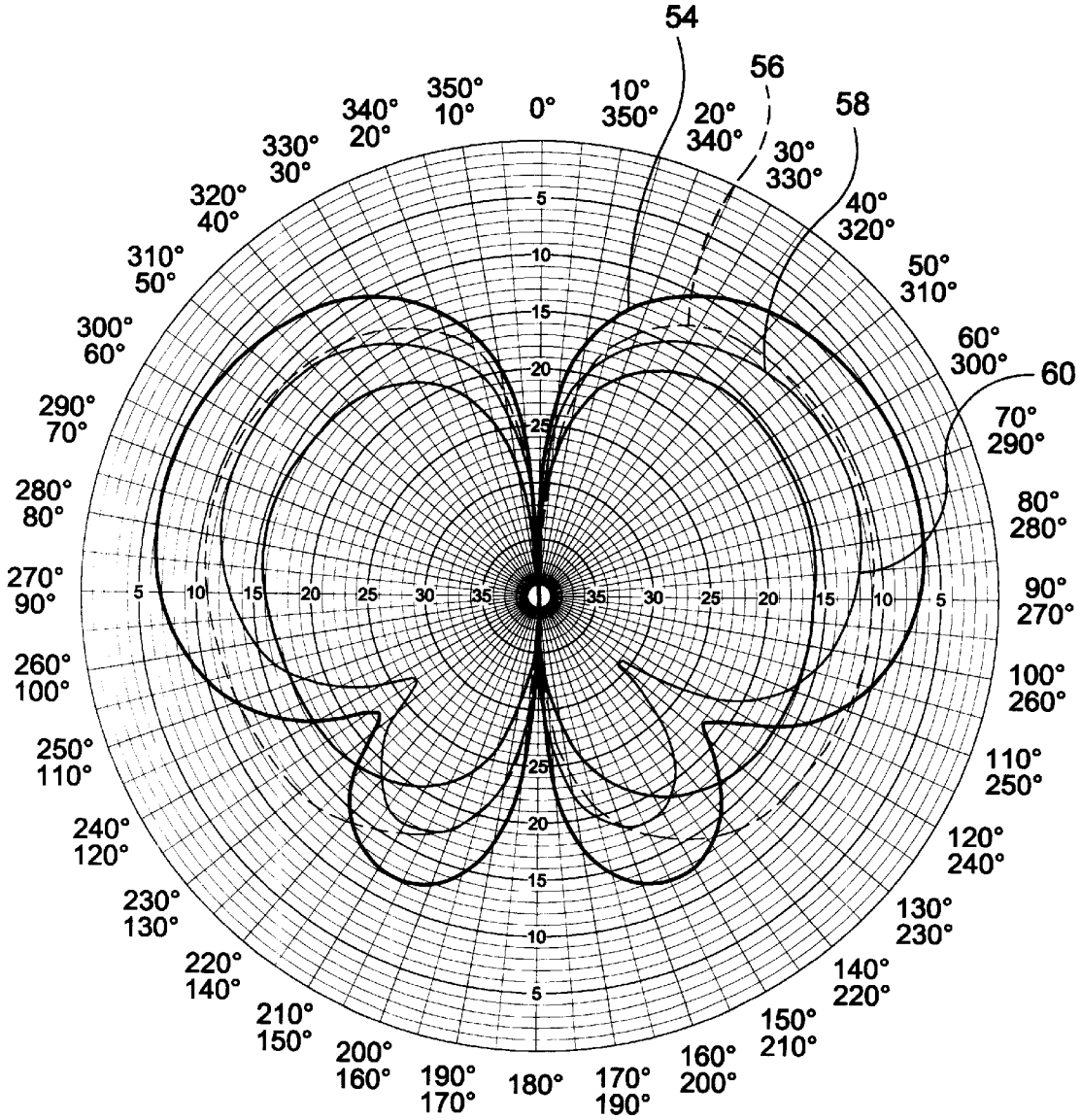
FIG. 7 illustrates a Fore/Aft and Port/Starboard radiation pattern for both a standard monopole or whip antenna and the antenna of the present invention at 127 Mhz.
Figure 8:
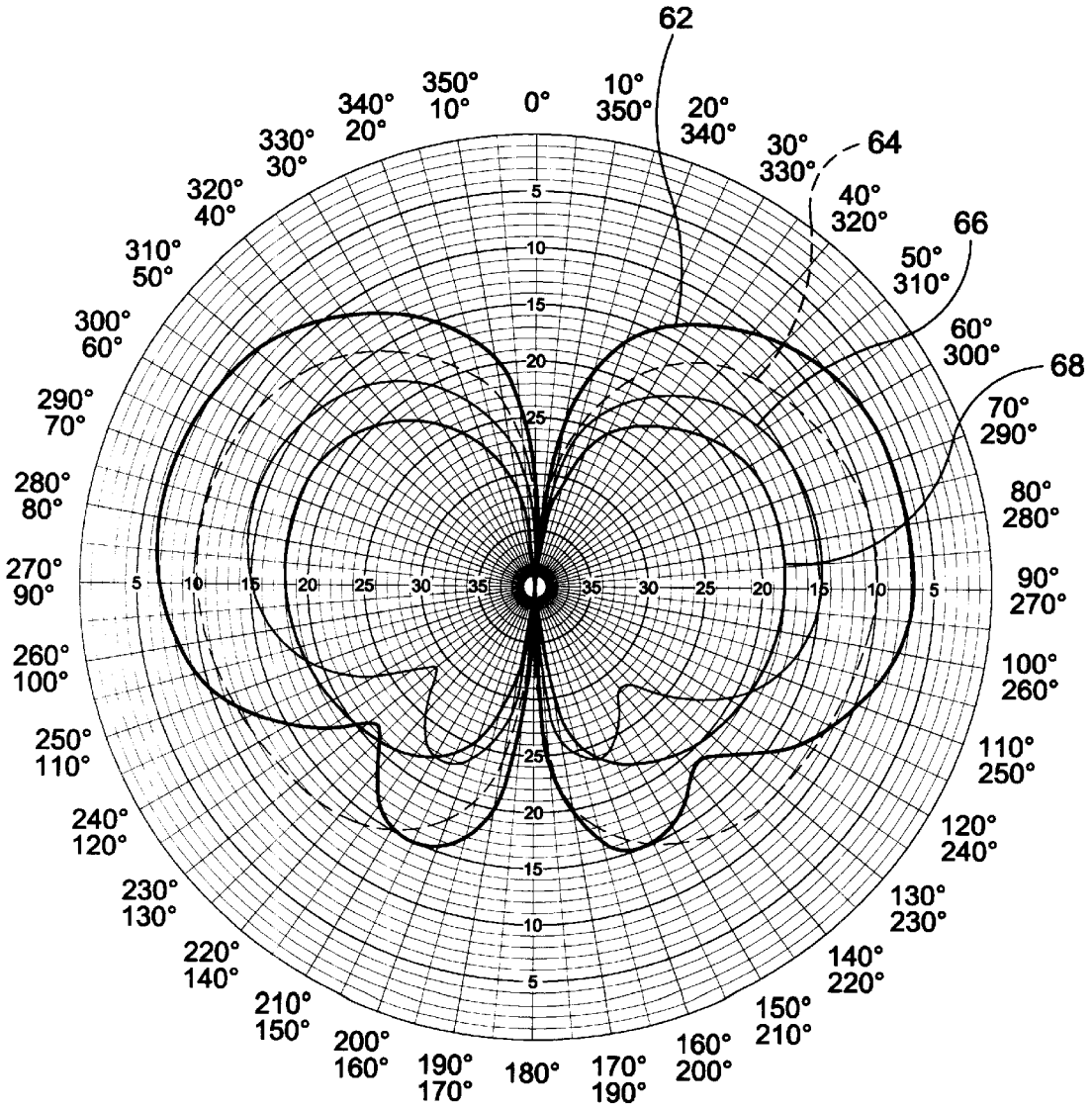
FIG. 8 illustrates a Fore/Aft and Port/Starboard radiation pattern for both a standard monopole or whip antenna and the antenna of the present invention at 136 Mhz.

As shown in FIG. 1 the antenna of the present invention comprises a vertical slot slightly longer than one half of one wave length at the lower range of the cellular communications L-band. The vertical slot provides horizontal polarization and omnidirectional radiation in the azimuth plane. The elevation pattern of the present invention is very similar to the elevation pattern of a monopole antenna as shown in FIGS. 6–8. The vertical slot is tuned by a horizontal slot at one end, and an open circuit at the other end. The width of the vertical slot is dielectrically loaded and the vertical slot is fed with a signal in the cellular communications L-band at substantially a center of the vertical slot.

The vertical slot is created by placing two cavity backed vertical slots face to face. A first cavity backed vertical slot is directly fed at substantially its longitudinal center with a first signal and this cavity backed vertical slot excites a second cavity backed vertical slot. Radiation is propagated through the action of the electric field as it traverses the discontinuity created by the vertical slot.

The horizontal slot structure is used as a monopole element for VHF vertical polarization. The horizontal slot is fed at substantially the center of a bottom plate. A VHF matching circuit is used to improve isolation between the VHF signal and the L-band signal and to improve VHF efficiency.

Figure 2:
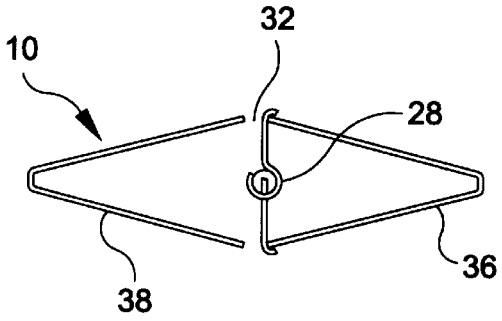
FIG. 2 represents a top, cross-sectional view taken from section AA of the embodiment of FIG. 1 of the apparatus for the dual frequency band antenna of the present invention.

FIG. 1 illustrates a side view of a dual frequency band antenna 10 of the present invention comprised of an antenna blade 12 The antenna blade 12 is suitable for airborne applications due to its aerodynamic structure as becomes obvious from inspection of a top cross-sectional view in FIG. 2. The antenna blade 12 comprises a first feed 14 which carries a first signal within a first channel 16 such that a first current is established in a first direction 18 resulting in a first polarization in the vertical direction.

In the embodiment shown in FIG. 1, the first signal is located within the VHF band. The first signal is input into the first channel 16 via an appropriate connector well known in the art, which then leads into a VHF matching circuit 20. The VHF matching circuit 20 improves isolation between the first channel 16 and a second channel 22 while improving VHF efficiency by compensating for the reduction in length of the resulting monopole exhibited by the dual frequency band antenna 10. The first signal in the VHF band is then fed to the center of a bottom plate 24 located just below a horizontal slot 26. The arrangement of the first feed 14 is such that the first direction 18 of the first polarization is established in a vertical direction. Thus, a first polarization of the VHF signal is in a vertical direction as shown in FIG. 1. The horizontal slot 26 is used as a monopole element displaying vertical polarization.

VHF or radiation efficiency is relevant to transmission or reception and is defined as follows:

1. In transmission, it is the fraction of available power from a generator that is radiated into space.
2. In reception, it is the fraction of available power from space that is delivered to a load representing the receiver, It is a measure of the ability of a received signal to overcome the noise level in the receiver circuit.

The efficiency of an antenna may also be defined as the ratio of the radiation resistance to the total resistance of the system. The total resistance includes radiation resistance, resistance in conductors and dielectrics (including any resistance in loading coils) and the resistance of the grounding system, usually referred to as ground resistance. The radiation resistance of a grounded vertical antenna as measured between the base of the antenna and ground, varies as a function of the antenna height.

The polarization of an antenna in a given direction is the polarization of the wave radiated by the antenna in that direction. Alternatively, it is the polarization of a wave incident from the given direction which results in the maximum available power at the antenna terminals. Given direction is generally defined as that direction at which the antenna exhibits maximum gain.

An electromagnetic wave may be considered to consist of two orthogonal vectors representing the electric and magnetic fields, and a third vector, orthogonal to the first two, representing the direction of propagation. It is conventional in electrical engineering practice to specify the polarization of the wave by the orientation of the electric field vector. If the orientation of the electric field vector does not deviate from a straight line as it appears to move in the direction of propagation, the wave is linearly polarized. For instance, the first channel 16 and second channel 22 of the present invention are linearly polarized. If the electric field vector appears to rotate with time, then the wave is elliptically polarized. The ellipse so described may vary in ellipticity from a circle to a straight line, or from circular to linear polarization. In a general sense all polarizations may be considered to be elliptical. In engineering practice, however, linear polarization and circular polarization conform to precise definitions, but elliptical polarization is sometimes called circular polarization, with a tolerance added to define the permissible ellipticity.

Antennas designed to radiate and receive linearly polarized waves are numerous, but the origins of all can be traced to two basic types: the dipole and its complement, the slot antenna. The slot antenna is utilized in the present invention and appears as both the horizontal slot 26 and the vertical slot 32. The polarization of the wave radiated by a dipole is oriented along the long dimension of the dipole, whereas the polarization of the slot is oriented across the short dimension. Thus the development of horizontal polarization through excitation by the second signal within the cellular communications L-band of the present invention is provided across the short dimension (i.e. in the horizontal direction) of the vertical slot 32. Likewise, the development of vertical polarization through excitation by the first signal within the VHF band of the present invention is provided across the short dimension (i.e. in the vertical direction) of the horizontal slot 26.

Polarization considerations sometimes will dictate what the antenna characteristics will be in a given system. If the signal that you are trying to collect has vertical polarization and your antenna has horizontal polarization, theoretically the system will not detect it. For any antenna having a single feed of a specific polarization, there is one polarization that it cannot receive—that being a signal having orthogonal polarization. Thus, this concept which limits the reception of signals by antennas also provides the theoretical basis for the design of the present invention-namely that orthogonal polarizations will function to limit the mutual coupling normally found between the orthogonally polarized antennas in the same physical structure. Electromagnetic waves possessing unlike polarizations will result in a loss of power from that level that could have been received from an antenna that had like polarization. An example of this would be the apparent 3 dB loss of the reception by a linearly (either horizontal, vertical or slant) polarized antenna from a wave having circular polarization. The term like polarization merely means that the electromagnetic wave and the receiving antenna have the same polarization, or are matched. Since most radars will transmit a polarization that is either circular or linear (either vertical or horizontal), a general purpose polarization that enjoys wide application is slant linear (either left slant or right slant) which has been utilized in the embodiment of the present invention as shown in FIG. 1. The penalty that must be paid with the slant back antenna is a loss of 3 dB in gain that could have been obtained had the polarization been exactly matched (i.e. reception of a precisely horizontally polarized wave via a precise horizontally polarized antenna created with a precisely vertical vertical slot 32).

Additional information regarding polarization and its application to the present invention may be obtained from the following publication hereby incorporated by reference:

1. Pike, Beuhring W., *Power Transfer Between Two Antennas with Special Reference to Polarization*, Vanderberg Air Force Base, California: Air Force Systems Command, December 1965, AD637 134, Technical Report AF WTR-TR-65-1.
2. Hill, John E., *Antenna Designer's Guide—Antenna Polarization*, Watkins-Johnson Company Antennas and Antenna Systems Brochure 1990.
3. Janich, David Z., *Antenna Designer's Guide—RF Signal Processing Before the Receiver*, Watkins-Johnson Company Antennas and Antenna Systems Brochure 1990.

The value of the characteristic impedance of a transmission line such as that utilized in the first channel 16 is equal to the square root of its inductance per unit length of line divided by its capacitance per unit length of line. This is true assuming a perfect transmission line wherein the conductors have no resistance and there is no leakage between them. The inductance decreases with increasing conductor diameter, and the capacitance decreases with increasing spacing between the conductors. Hence a line with closely spaced large conductors has a relatively low characteristic impedance, while one with widely spaced thin conductors has a high impedance. Practical values of characteristic impedance for coaxial lines such as that used in the first and second channels vary from 30–100 ohms.

Practical lines have a definite length, and they are terminated in a load at the output end where the power is delivered. If the load is purely resistive and of a value equal to the characteristic impedance of the line, the current traveling along the line towards the load sees the load as simply more transmission line of the same characteristic impedance. A pure resistance equal to the characteristic impedance of the line absorbs all the power just as an infinitely long line would absorb all the power transferred to it.

A line terminated in a purely resistive load equal to the characteristic line impedance is said to be matched. In a matched transmission line, power is transferred outward along the line from the source until it reaches the load where it is completely absorbed. Thus, with either the infinitely long line or its matched counterpart, the impedance presented to the source of power is the same regardless of the line length. It is simply equal to the characteristic impedance of the line. The current in such a line is equal to the applied voltage divided by the characteristic impedance, and the power applied to it is equal to the square of the current multiplied by the characteristic impedance, by Ohm's Law.

If the terminating resistance is not equal to the characteristic impedance the line is said to be mismatched and the power reaching the mismatch is partially absorbed as incident power and partially reflected as reflected power. While purely resistive loads consume some if not all of the power a non-resistive load such as pure reactance can also be used to terminate a line. Such termination will consume no power and will reflect all of the energy arriving at one end of the line. In this case the theoretical Standing Wave Ratio (SWR) will be infinite, but in practice, losses in the line will limit the SWR to some finite value at line positions back toward the source. However, non-resistive loads are useful in altering the phase of the incoming signal in matching circuits well known in the art such as those used in the VHF matching circuit 20 of the present invention which employ inductors and capacitors in configurations well known in the art. The impedance matching as performed by the VHF matching circuit 20 can not be achieved with resistors alone. Using pure resistance in the VHF matching circuit 20 results in too great a loss into the VHF matching circuit 20 causing a concomitant loss in gain and inability to meet TSO requirements.

In any system using a transmission line to feed the antenna, the load that the transmitter sees is the input impedance of the line. This impedance is completely determined by the line length, the characteristic impedance of the line and the impedance of the load at the output end of the line. The line length and characteristic impedance are generally matters of choice to the designer. The antenna impedance, which may or may not be known accurately is, with the characteristic impedance of the line, the factor which determines the SWR. The SWR can easily be measured and from it the limits of variation in the line input impedance can be determined. Therefore, the problem of transferring power to the line can be solved by knowledge of the characteristic impedance of the line and the maximum SWR which may be encountered.

Since the input impedance of the transmission line that is connected to the present invention differs appreciably from the impedance value that the output circuit is designed to operate at an impedance matching network was required between the line and the antenna i.e. the VHF matching circuit 20. Several types of matching circuits are appropriate for such a use and are described in further detail in the following references which are hereby incorporated by reference:

1. Straw, R. Dean, *The ARRL Antenna Book*, American Radio Relay League, Newington Conn., 1994.
2. Carr, Joseph J., *Practical Antenna Handbook*, $2^{nd}$ ed., McGraw Hill, 1994.
3. Johnson & Jasik, *Antenna Engineering Handbook*, $2^{nd}$ ed., McGraw Hill, 1984.

The antenna blade 12 also comprises a second feed 28 which carries a second signal within a second channel 22 such that a second current resulting in a second polarization in the horizontal or second direction 30.

The second signal is within the L-band which is suitable for cellular communications applications. The second signal is then input into the second channel 22 and feeds the vertical slot 32 at substantially its longitudinal center. The vertical 32 slot is slightly longer than one half wavelength as measured at the lower range of the L-band (i.e. 824 Mhz to 896 Mhz). The vertical slot 32 provides horizontal polarization and omnidirectional radiation in the azimuth plane. The elevation pattern of the present invention is similar to the elevation pattern of a monopole antenna. The vertical slot 32 is tuned by a short circuit formed by the horizontal slot 26 at one end and an open circuit 34 at the other end. The width of the vertical slot 32 is dielectrically loaded by integrating a dielectric material within the vertical slot 32 which may typically be a volume of free space (i.e. air) but may alternatively be filled with other dielectric materials which are more suitable for maintaining the structural integrity of the dual frequency band antenna 10 particularly in airborne applications which place a great deal of mechanical stress on antenna components. The arrangement of the second feed 28 is such that the second direction 30 of the second polarization is established in a horizontal direction. Thus the second polarization of the L-band signal is in the horizontal as shown in FIG. 1.

The vertical slot 32 comprises a first cavity backed vertical slot 36 and a second cavity backed vertical slot 38 in a face-to-face arrangement as shown in FIG. 2. The first cavity backed vertical slot 36 is dielectrically loaded and fed substantially its center with the second signal in the L-band via the second channel 22 at the second feed 28. The second cavity backed vertical slot 38 is excited by the electric field generated by the first cavity backed vertical slot 36. Radiant energy propagates as the excitation signal in the first cavity backed vertical slot 38 reaches the discontinuity created by the vertical slot 36 between the first cavity backed vertical slot 36 and the second cavity backed vertical slot 38.

The first feed 14 and the second feed 28 are adapted to isolate the electrical and electromagnetic characteristics of the first channel 16 from those of the second channel 22 and vice-versa due to the orthogonal relationship between the resulting polarizations of radiant energy and the wide variance in frequencies between the VHF band and the L-band. The isolation between the first channel 16 and the second channel 22 permits both channels to transmit and receive energy within different bands simultaneously using the same physical antenna structure without appreciable coupling or interference in the resulting signals. Coupling creates the potential for degradation in the performance and efficiency of both channels.

The present invention is able to match the impedance of applied signals in both the VHF band and L-band within the same physical antenna structure while providing sufficient gain to meet Time Sharing Option (TSO) requirements (i.e. 6 dB below a typical monopole radiation pattern at its peak using the identical ground plane with a 3.0:1 VSWR match). Through experimentation it was concluded that the slant-back embodiment of the antenna blade 12, as illustrated in FIG. 1, yields a balanced pattern lifting in the Fore/Aft direction. The embodiment illustrated in FIG. 1 was housed in a radome (i.e. an electrically and electromagnetically neutral cover to protect the active antenna components from the environment without degrading performance) manufactured from compression molded epoxy fiberglass. The overall height of the antenna blade 12 including the radome was 9.75 inches. All pattern, gain and VSWR measurements were performed on an A/C curved ground plane which was 8 feet in diameter Experimental results show that the present invention provides an approximately 1 db increase in gain over the small scale CT4 antenna described above. The Fore/Aft roll off of the present invention is approximately the same as that of the small scale CT4 type antenna. The Port/Starboard roll off shows an improvement over the small scale CT4 type antenna, described above, by approximately 1 dB.

A marked difference between the slant back embodiment of the present invention and a perpendicular embodiment of the antenna blade 12 is that the delta between Fore/Aft measurements taken at the horizon is 2 dB greater in the perpendicular embodiment as compared to the slant-back embodiment of the present invention shown in FIG. 1. This concludes that despite the Fore/Aft pattern lifting as measured from the horizon for shorter versions of the antenna blade 12 the slant back embodiment provides a balanced Fore/Aft radiation pattern.

The antenna blade 12 was mounted such that the Fore/Aft edge of the antenna blade 12 was located in the Port/Starboard position of the ground plane. Experimental results conclude that in order to lower the Fore/Aft rolloff when mounted on a typical aircraft, the antenna blade 12 must be mounted higher from the ground plane.

Figure 3:
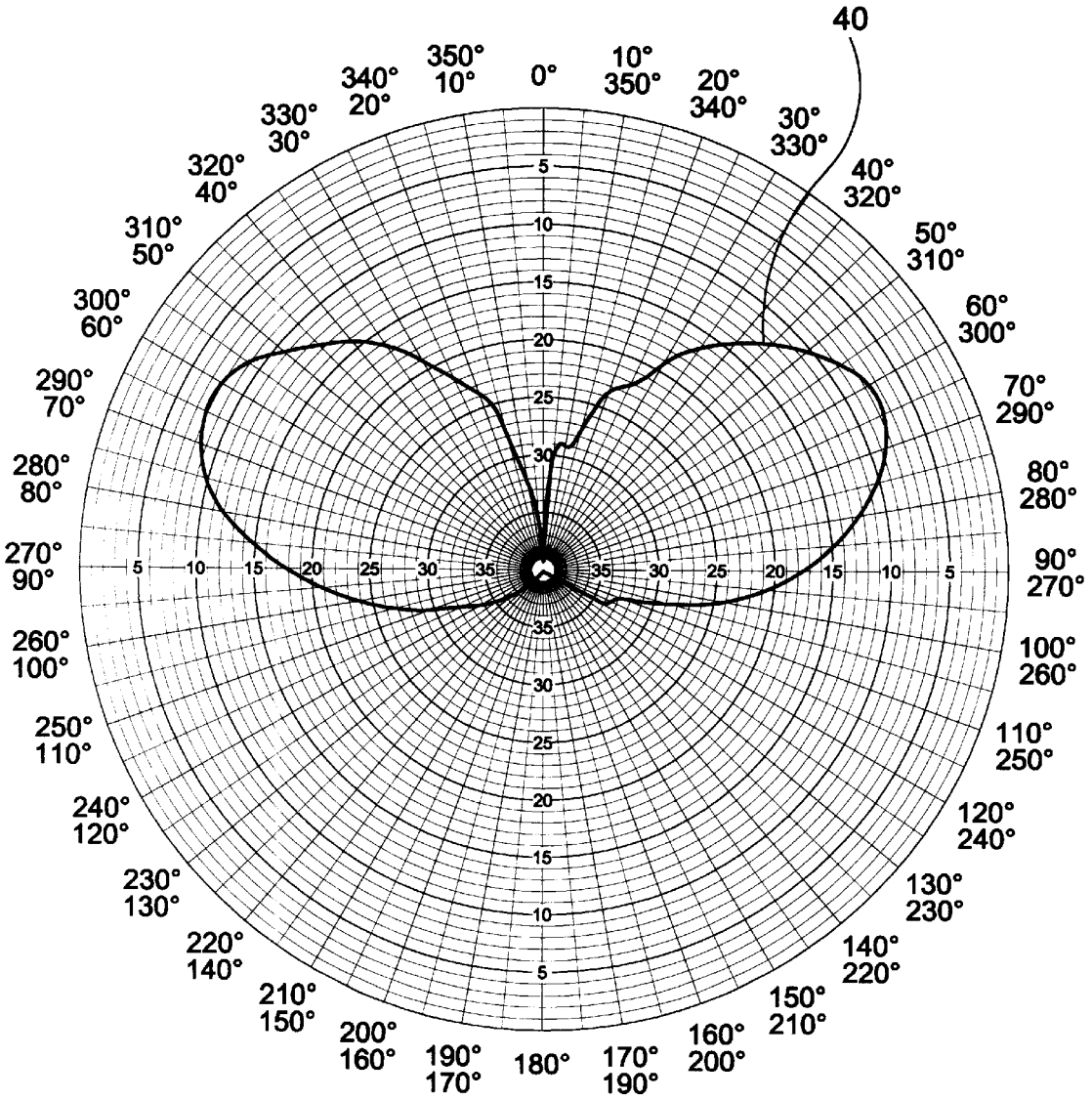
FIG. 3 represents an antenna pattern diagram illustrating a Port/Starboard elevation radiation pattern within the cellular communications L-band at 896 Mhz for the present invention.
Figure 4:
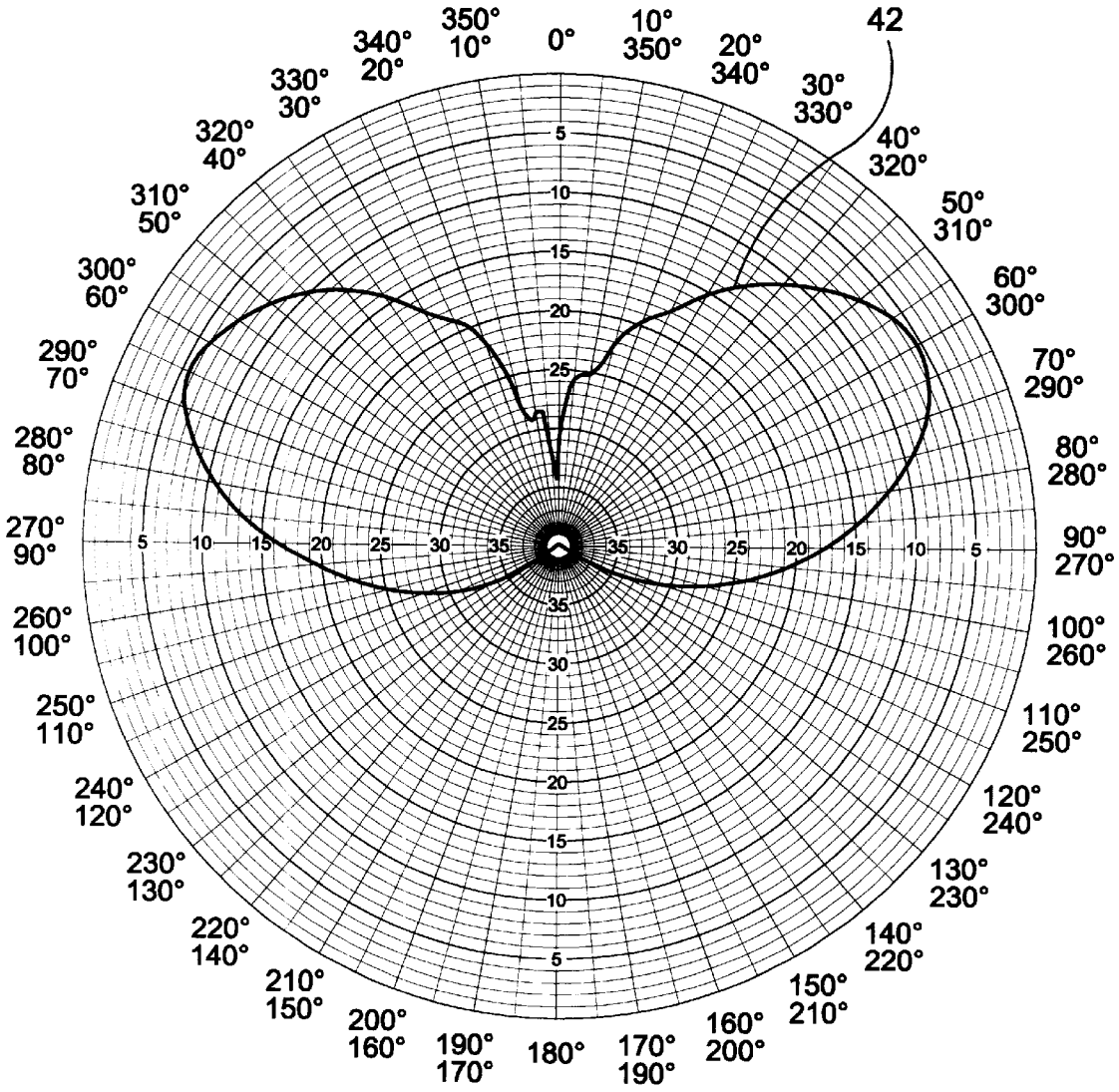
FIG. 4 represents an antenna pattern diagram illustrating a Fore/Aft radiation pattern within the cellular communications L-band at 896 Mhz for the present invention.
Figure 5:
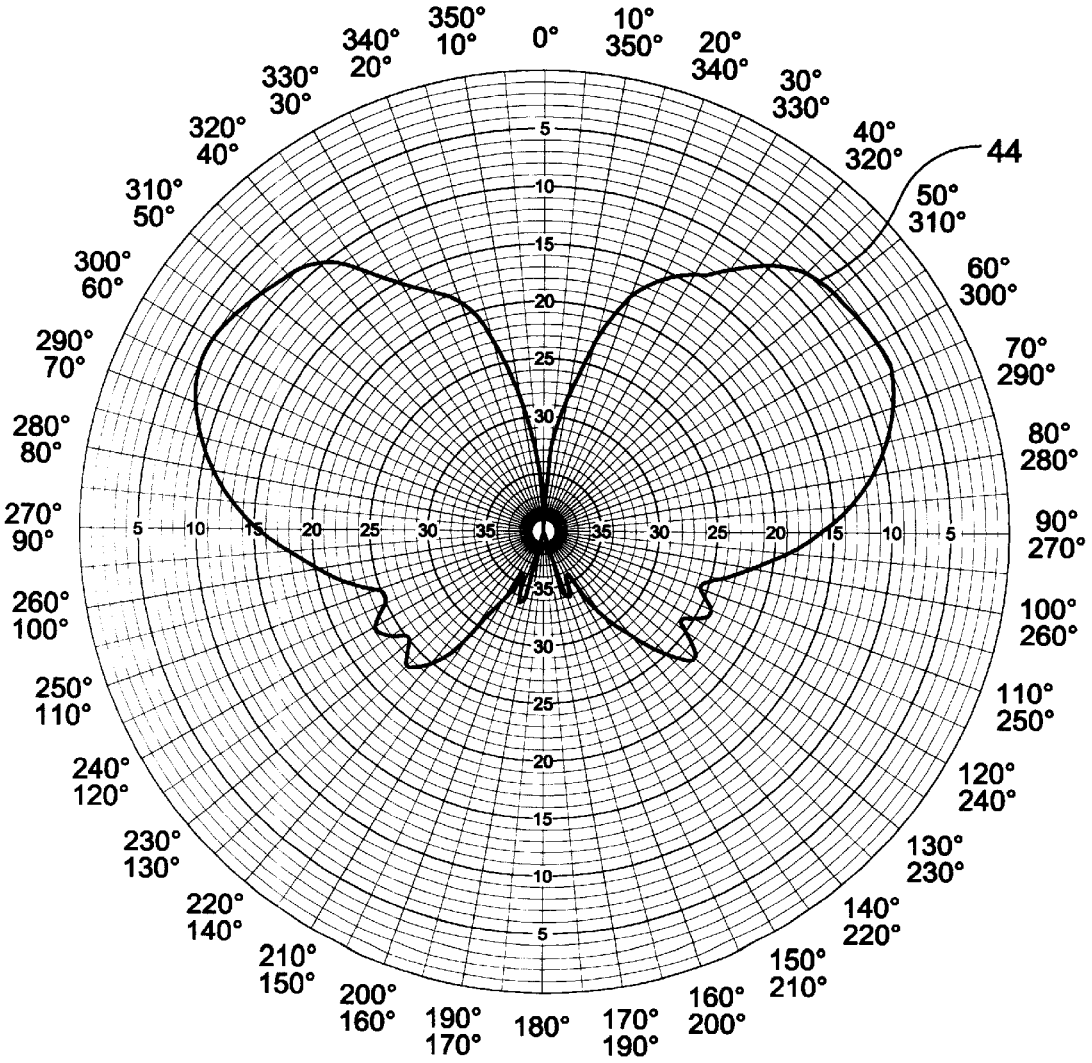
FIG. 5 represents an antenna pattern diagram illustrating a Fore/Aft radiation pattern within the cellular communications L-band at 860 Mhz for the present invention.

Port/Starboard elevation and Fore/Aft radiation patterns in the cellular communications band (at 896 Mhz) were obtained using an 8 foot diameter ground plane and are shown at reference numeral 40 on FIG. 3 and reference numeral 42 on FIG. 4, respectively. These figures demonstrate pattern lifting along the longitudinal dimension of the A/C ground plane. A Fore/Aft radiation pattern in the cellular communications band (at 860 Mhz) using an 8 foot diameter ground plane is shown at reference numeral 44 in FIG. 5.

FIGS. 6, 7, and 8 illustrate antenna patterns for the present invention as compared with those of a standard monopole antenna such as a whip antenna. FIG. 6 shows a Fore/Aft radiation pattern for a standard monopole antenna at reference numeral 46; a Port/Starboard radiation pattern for a standard monopole antenna at reference numeral 48; a Fore/Aft radiation pattern for the antenna of the present invention at reference numeral 50; and a Port/Starboard radiation pattern for the antenna of the present invention at reference numeral 52 measured at 118 Mhz. FIG. 7 shows a Fore/Aft radiation pattern for a standard monopole antenna at reference numeral 54; a Port/Starboard radiation pattern for a standard monopole antenna at reference numeral 56; a Fore/Aft radiation pattern for the antenna of the present invention at reference numeral 58; and a Port/Starboard radiation pattern for the antenna of the present invention at reference numeral 60 measured at 127 Mhz. FIG. 8 shows a Fore/Aft radiation pattern for a standard monopole antenna at reference numeral 62; a Port/Starboard radiation pattern for a standard monopole antenna at reference numeral 64; a Fore/Aft radiation pattern for the antenna of the present invention at reference numeral 66; and a Port/Starboard radiation pattern for the antenna of the present invention at reference numeral 68 as measured at 136 Mhz. In summary, it must be noted from an inspection of the foregoing figures that the antenna of the present invention exhibits radiation patterns of the same general shape as a standard monopole antenna with the exception that there is a lack of emphasized side lobes as evident in the standard monopole radiation patterns of FIGS. 6–8.

The present invention also embodies a method of exciting an antenna blade 12 with two signals of different frequency bands which comprises feeding the first channel 16 of the antenna blade 12 with the first frequency band such that the first current is established in the first direction 18 resulting in the first polarization. The second channel 22 of the antenna blade 12 is fed with the second frequency band such that the second current is established in the second direction 30 resulting in the second polarization. The arrangement of the signal feeds and the resulting polarizations are such that isolation is achieved between the electrical and electromagnetic characteristics of the first channel 16 from the electrical and electromagnetic characteristics of the second channel 22 and vice-versa. Thus both the first channel 16 and the second channel 22 are adapted to transmit and receive energy simultaneously within one antenna structure without appreciable coupling between channels. Coupling creates the potential for degradation in performance of both the first channel 16 and the second channel.

In the embodiment shown in FIG. 1 the first frequency band occupies the VHF band and the second frequency band occupies the cellular communications L-band. Thus this method is particularly suited to airborne applications. In order to achieve isolation between the two frequency bands the resulting first and second polarizations could be established with an orthogonal relationship to each other. For example, the VHF band signal could be fed to the first channel 16 such that vertical polarization is achieved and the L-band signal could be fed to the second channel 22 such that horizontal polarization is achieved.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. A method of exciting an antenna element comprising the steps of:

feeding a first channel of said antenna element with a first signal to establish a first current in a first direction such that said first signal has a first polarization when transmitted;

feeding a second channel of said antenna element with a second signal to establish a second current in a second direction such that said second signal has a second polarization when transmitted; and isolating said first channel from said second channel to enable said first and said second signals to be simultaneously transmitted, or simultaneously received, or one of said signals being transmitted while the other signal is being received within one antenna element without appreciable coupling between said first channel and said second channel.

2. A method of exciting an antenna element as defined by claim 1, further comprising the step of forming said antenna element in the shape of a blade suitable for airborne applications.

3. A method of exciting an antenna element as defined by claim 1, wherein said step of feeding said first channel of said antenna element with a first signal further comprises establishing said first current in a vertical direction such that said first signal has a vertical polarization when transmitted.

4. A method of exciting an antenna element as defined by claim 1, wherein said step of feeding said second channel of said antenna element with a second signal further comprises establishing said second current in a horizontal direction such that said second signal has a horizontal polarization when transmitted.

5. A method of exciting an antenna element as defined by claim 1, wherein said steps of feeding said first channel and said second channel to establish said first and second currents such that said first polarization is orthogonal to said second polarization.

6. A method of exciting an antenna element as defined by claim 1, further comprising the steps of:

providing a first and a second cavity backed vertical slot in a face-to-face arrangement to define therebetween a first vertical slot;

feeding said first cavity backed vertical slot with said first channel; and exciting said second cavity backed vertical slot with said first cavity backed vertical slot.

7. An antenna element comprising:

a first feed feeding a first signal to a first channel to establish a first current in a first direction such that said first signal has a first polarization when transmitted; and a second feed feeding a second signal to a second channel to establish a second current in a second direction such that said second signal has a second polarization when transmitted, said first channel and said second channel being isolated to enable said first and second signals to be simultaneously transmitted, or simultaneously received, or one of said signals being transmitted while the other is being received within one antenna element without appreciable coupling between said first channel and said second channel.

8. An antenna as defined by claim 7, wherein said antenna element is formed in the shape of a blade suitable for airborne applications.

9. An antenna as defined by claim 7, wherein said first polarization is vertical.

10. An antenna as defined by claim 7, wherein said second polarization is horizontal.

11. An antenna as defined by claim 7, wherein said second polarization and said first polarization are orthogonal.

12. An antenna as defined by claim 7, wherein said antenna element further comprises a first and a second cavity backed vertical slot in a face-to-face arrangement to define therebetween a first vertical slot, said first cavity backed vertical slot being fed by said first channel and said second cavity backed vertical slot being excited by said first cavity backed vertical slot.

* * * * *